United States Patent [19]

Ryckman, Jr. et al.

[11] 4,031,638

[45] June 28, 1977

[54] STEAM IRON WATER GAUGE

[75] Inventors: William D. Ryckman, Jr.; Lester D. Little, both of Asheboro, N.C.

[73] Assignee: General Electric Company, Bridgeport, Conn.

[22] Filed: Aug. 20, 1976

[21] Appl. No.: 716,103

[52] U.S. Cl. ..... 38/77.2
[51] Int. Cl.² ..... D06F 75/06
[58] Field of Search ..... 38/77.2

[56] References Cited

UNITED STATES PATENTS

| | | | |
|---|---|---|---|
| 1,068,626 | 7/1913 | Buck | 38/77.2 |
| 3,193,954 | 7/1965 | Robison | 38/77.2 |
| 3,298,118 | 1/1967 | Vieceli | 38/77.2 |
| 3,298,119 | 1/1967 | Vieceli | 38/77.2 |

FOREIGN PATENTS OR APPLICATIONS

| | | | |
|---|---|---|---|
| 2,005,612 | 9/1970 | Germany | 38/77.2 |

*Primary Examiner*—Patrick D. Lawson
*Attorney, Agent, or Firm*—John F. Cullen; George R. Powers; Leonard J. Platt

[57] ABSTRACT

A steam iron having an exterior wall portion which at least partially defines an internal water reservoir and a cover member secured and peripherally sealed to the outer surface of the exterior wall portion to form therewith a chamber communicating with the reservoir through relatively small spaced-apart openings in the exterior wall portion. Both the cover and wall are preferably of a heat resistant plastic. The exterior wall portion is aligned to cover or conceal the openings which are positioned so the water level in the reservoir is indicated through a transparent portion of the cover member when the iron is disposed in either a horizontal ironing position or a vertical filling position.

9 Claims, 5 Drawing Figures

STEAM IRON WATER GAUGE

BACKGROUND OF THE INVENTION

1. Field of the Invention

This invention relates to steam irons and, more particularly, to improved means for indicating the amount of water in the water reservoirs of such irons.

2. Description of the Prior Art

It is common practice to provide steam irons having steam and/or spray capabilities with some form of water level gauge as it is undesirable to have the supply of water exhausted unexpectedly during ironing. Various types of water level gauges are used to monitor the water level, some indicating the level only when the iron is in a vertical or filling position and others indicating the level only when the iron is in a horizontal ironing position. It has also been known to provide steam irons with water gauges capable of indicating the water level when the iron is either in its vertical or horizontal positions but they have been somewhat complex structures using tubes or relatively large openings in the side walls of the iron.

SUMMARY OF THE INVENTION

It is an object of this invention to provide improved means for indicating the water level when a flat iron is in either vertical or horizontal positions.

Another object of the invention is to provide a simple water level gauge construction which is capable of multi-position water level indication while not requiring the use of tubes, large wall openings or other means extending into the water reservoir of the iron.

Another object is to provide a relatively stable indication of water level even while water in the reservoir is turbulent due to motion of the iron.

Another object of the invention is to provide a simple water level gauge construction capable of multi-position water level indication while not requiring tubes, large wall openings or other means extending into the water reservoir.

A still further object is to provide the foregoing objects in an iron having an exterior wall portion which also partially defines the water reservoir of the iron.

Yet another object is to provide a simple and relatively inexpensive means for indicating the water level in a steam iron when the iron is positioned in either vertical or horizontal positions.

Still another object is to provide the foregoing objects without adversely affecting the structural integrity of the water reservoir or side wall of the iron.

The invention is shown and described specifically with reference to a steam iron although, as noted above, it is equally applicable to a spray only iron as claimed.

Briefly stated, a steam iron having a soleplate and exterior wall means positioned above the soleplate in a fixed position relative to the soleplate is provided with means for indicating the water level in a tank or reservoir within or formed by the exterior wall means. The exterior wall means includes a vertical wall portion both when the iron is positioned with the soleplate horizontal and when the iron is positioned with the soleplate vertical. The water reservoir is preferably at least partially defined by the wall portion, and cover means is secured and peripherally sealed to the outer surface of the wall portion to define with the wall portion a chamber intermediate the cover means and the wall portion. A portion of the cover means is transparent for viewing the chamber through the cover means. The wall portion has at least two relatively small spaced-apart placed openings providing communication between the chamber and the water reservoir. A selected one of the openings communicates with a relatively low portion of the water reservoir and another selected one of the openings communicates with a relatively high portion of the water reservoir when the soleplate is disposed horizontally or vertically.

In accordance with further aspects of the invention, the wall portion and the cover means are formed of plastic material having relatively high temperature resistance. The selected opening communicating with a relatively low portion of the water reservoir when the soleplate is horizontal is the same as the selected opening communicating with a relatively low portion of the water reservoir when the soleplate is vertical. Similarly, the selected opening communicating with a relatively high portion of the water reservoir when the soleplate is horizontal is the same as the selected opening communicating with a relatively high portion of the water reservoir when the soleplate is vertical. By a still further aspect of the invention, the transparent portion of the cover means is disposed vertically above each of the respective low openings such that the observation through the cover means of water within the chamber indicates that the water level within the chamber is above the respective low opening. By a yet further aspect of the invention, all of the openings through the wall portion are so disposed as to not be visible through the transparent portion of the cover means.

BRIEF DESCRIPTION OF THE DRAWINGS

While the novel features of this invention are set forth with particularity in the appended claims, the invention, both as to organization and content, will be better understood and appreciated, along with other objects and features thereof, from the following detailed description taken in conjunction with the drawings, in which:

The invention is described in connection with a steam iron of the spray type although it should be understood that it is applicable to any type of steam or other iron that uses a fluid whose level is to be constantly visible.

The invention discloses a steam iron that is operable dry, or steaming, and which has provision for a spray and which also, by suitable mechanism, may include means to provide a sudden surge of steam and all such combinations are contemplated.

Figure 1:
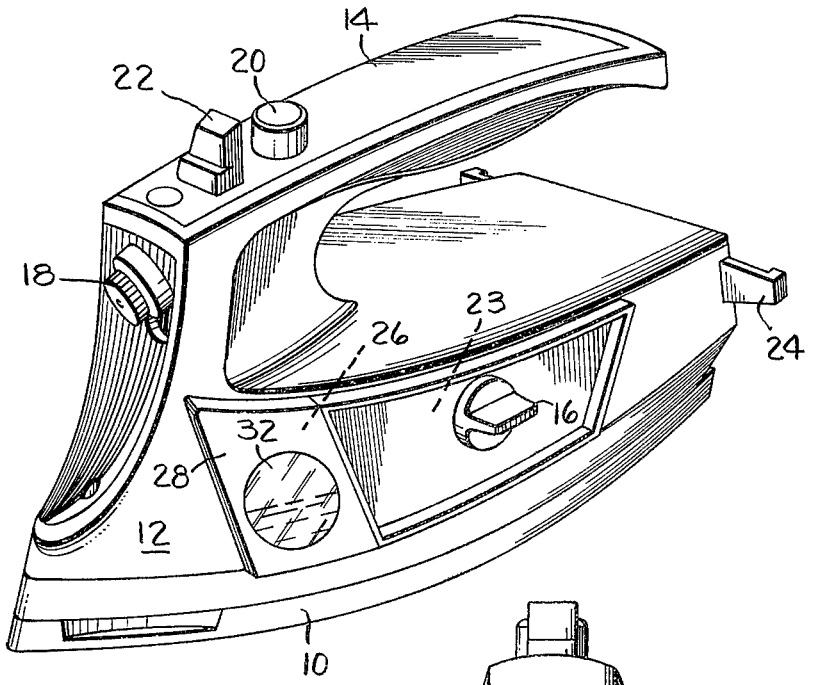
FIG. 1 is a perspective view of a steam iron incorporating the present invention.
Figure 2:
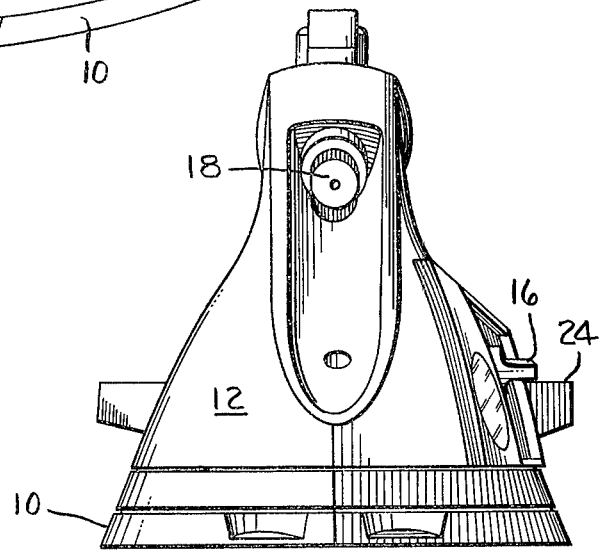
FIG. 2 is a front elevation view of the iron illustrated by FIG. 1.

Referring to FIG. 1, there is shown an electric steam iron that includes a soleplate 10 with a conventional plurality of steam ports not shown to direct steam through the soleplate for steaming fabrics while ironing in the conventional manner. The iron is provided with a metal or plastic shell 12 that comprises an exterior wall means positioned and fixed above the soleplate and suitabley connected thereto. For operating, the iron is provided with closed or open handle 14 as shown. In accordance with conventional practice, soleplate 10 is made from material such as cast aluminum with an electrical heating element cast in the soleplate or secured thereto which is controlled by a thermostatic means 16 suitably calibrated for the common fabrics and the iron is operable through a cord not shown all well known in the art. The iron may include a spray 18 operable by button 20 and the iron is operable dry or steaming depending on the position of control knob 22, which when in the up position as shown, permits water from an internal reservoir or tank 23 to drip into a boiler cavity and generate steam all as well known.

Figure 4:
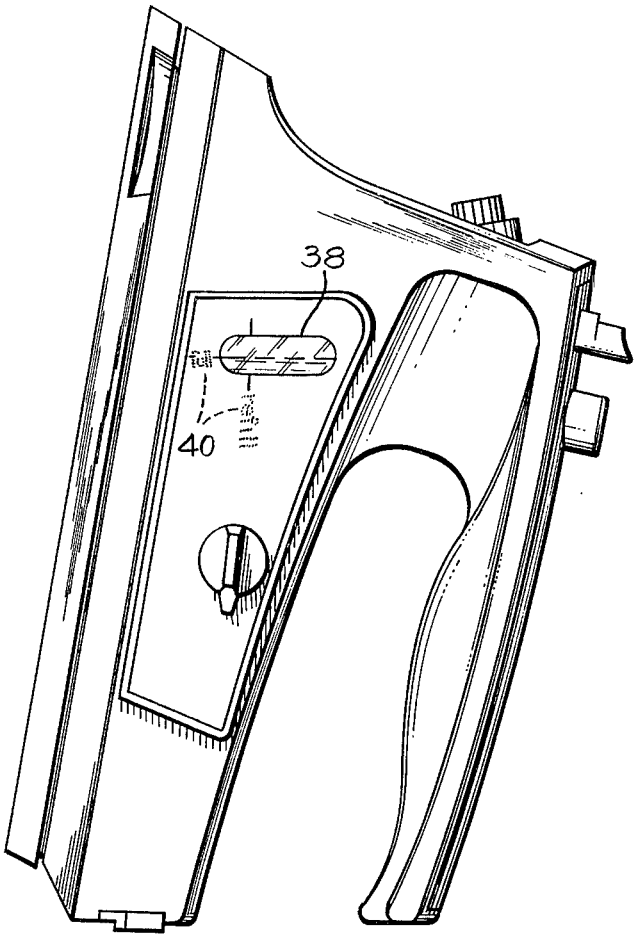
FIG. 4 is a view similar to FIG. 3 showing the iron resting on its heel with the soleplate substantially vertical with a modified gauge.
Figure 5:
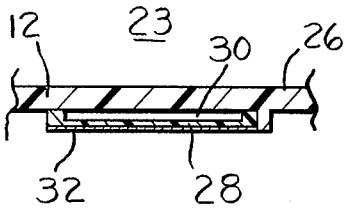
FIG. 5 is a partial cross-section view taken along viewing line 5—5 of FIG. 3.

For storing the iron, it is tilted to its heel rest position as shown in FIG. 4 where a suitable support means 24 provides stability to the iron.

In accordance with the invention, any suitable internal water reservoir or tank 23 of the conventional type may be employed or, preferably, the shell 12 may actually form a wall of the reservoir as contemplated herein. In either case, a water reservoir is provided within the exterior wall means or shell 12.

In accordance with the invention, an improved means is provided for indicating the water level when the iron is in either vertical or horizontal positions and to provide a visible indication at all times. To this end, a selected wall portion 26 of the exterior wall means 12 is provided in the forward portion of the iron as shown in FIG. 1. Thus, the selected portion 26 at least partially defines the water reservoir within exterior wall 12. The selected wall portion 26 is disposed to provide a substantially vertical portion when the iron is positioned either horizontally or vertically as will be apparent. For using the wall portion 26 there is provided a cover means 28 that is secured and peripherally sealed to the outer surface of the wall portion to define a chamber 30 between the cover and wall portion. A portion 32 of the cover means 28 is suitably transparent so that chamber 30 may be seen directly through the transparent portion.

In order to provide fluid access to the chamber, the selected wall portion has at least two relatively small spaced-apart openings 34, 36, connecting the chamber and the internal water reservoir. These openings act much like the common tube sight gauge and permit the chamber to fill the water to the level of the tank water in the iron as will be apparent.

Figure 3:
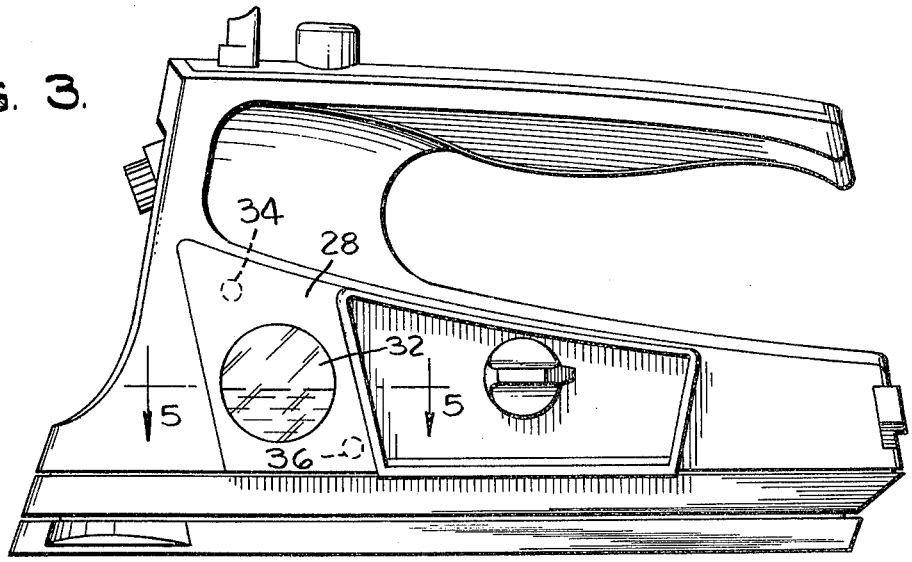
FIG. 3 is a left side elevation view of the iron illustrated by FIG. 1.

To avoid any large wall-weakening openings, the separate openings 34 and 36 may be relatively small and are preferably diagonally disposed as shown so that one of the openings 34 always communicates with the high portion of the water reservoir and the other opening 36 communicates with the low portion of the reservoir whether the iron is in the horizontal position of FIG. 3 or the vertical position of FIG. 4. Further, in order to avoid seeing into the interior of the water tank through any openings, each opening is disposed out of view through the transparent portion 32 i.e. the openings are disposed vertically above and behind the non-transparent portion of cover means 28. Thus, the same opening 34 is in the high portion of the chamber and reservoir in both horizontal and vertical positions of the iron as is the low opening 36 in the low portion. This, and the diagonal positioning, permit the use of two relatively small openings in the chamber and avoids any interior view of the water tank and any large hole-weakening opening in the wall or the use of connecting tubes.

If the iron is constructed of plastic, both the exterior walls means 12 and the cover means 28 are of a material such as polypropylene, polycarbonate, or polysulfone capable of withstanding relatively high operating temperatures without any deformation or deterioration.

FIG. 4 illustrates a slight modification wherein the transparent portion of the water gauge is an elongated bubble 38 that operates in identical fashion as the circular transparent gauge 32 of FIGS. 1 and 3. To constantly monitor the water level and need for refilling, suitable indicia 40 may be disposed on the opaque portion of the cover means to indicate when the iron is full of water or needs refilling which is then done in the conventional manner.

Thus, the present water gauge provides a convenient and inexpensive constant monitoring without the use of tubes or hole-weakening openings in the side walls of the iron and, by the use of small openings permits water entry into the chamber for continuous visibility. By disposing the openings behind the opaque portion and disposing them diagonally, only two small openings are required which are not visible to the user. A suitable material may be used on the transparent portion 32 to wet the inside for a higher refraction and easier viewability as is well known.

While there has been described preferred forms of the invention, obvious equivalent variations are possible in light of the above teachings. It is therefore to be understood that, within the scope of the appended claims, the invention may be practiced otherwise than as specifically described, and the claims are intended to cover such equivalent variations.

What is claimed as new and is desired to secure by Letters Patent of the United States is:

1. An iron comprising:

a soleplate, exterior wall means positioned above said soleplate in a fixed position relative to said soleplate, a selected wall portion of said exterior wall means having a vertical portion when the iron is positioned both horizontally and vertically, a water reservoir within said exterior wall means at least partially defined by said selected wall portion, and cover means secured and peripherally sealed to the outer surface of said selected wall portion and defining therewith a chamber intermediate said cover means and said selected wall portion, at least a portion of said cover means being transparent to permit said chamber to be viewed through said cover means, said selected wall portion having at least two relatively small spaced-apart openings therein providing direct communication between said chamber and said water reservoir, each opening being disposed out of view through said transparent portion, one of said openings communicating with a relatively low portion of said water reservoir and another of said openings communicating with a relatively high portion of said water reservoir when said soleplate is disposed horizontally or vertically, whereby a range of water levels within said water reservoir may be determined by observing the water level in said chamber through said cover means when the iron is disposed both horizontally and vertically.

2. An iron as defined by claim 1 in which both said exterior wall means and said cover means are formed of plastic material capable of withstanding relatively high operating temperatures without substantial deformation or deterioration.

3. An iron as defined by claim 1 in which the selected opening communicating with a relatively low portion of said water reservoir when said soleplate is disposed horizontally is the same as the selected opening communicating with a relatively low portion of said water reservoir when the soleplate is disposed vertically.

4. An iron as defined by claim 3 in which the selected opening communicating with a relatively high portion of said water reservoir when the soleplate is disposed horizontally is the same as the selected opening communicating with a relatively high portion of said water reservoir when the soleplate is disposed vertically.

5. An iron as defined in claim 4 wherein the selected openings comprise two separate openings, diagonally disposed in both the horizontal and vertical positions of the iron.

6. An iron as defined by claim 1 in which the transparent portion of said cover means is disposed vertically above each of the respective low openings so the openings are disposed out of view, whereby observation through said cover means of water within said chamber indicates that the water level within said chamber is above the respective low opening.

7. An iron as defined by claim 6 in which the openings comprise diagonal high and low openings in both horizontal and vertical positions and are located out of the field of view through the transparent portion of said cover means.

8. An iron as defined by claim 7 in which the selected opening communicating with a relatively low portion of said water reservoir when said soleplate is disposed horizontally is the same as the selected opening communicating with a relatively low portion of said water reservoir when the soleplate is disposed vertically.

9. An iron as defined by claim 8 in which the selected opening communicating with a relatively high portion of said water reservoir when the soleplate is disposed horizontally is the same as the selected opening communicating with a relatively high portion of said water reservoir when the soleplate is disposed vertically.

* * * * *